US008294089B2

(12) United States Patent
Suzuki et al.

(10) Patent No.: US 8,294,089 B2
(45) Date of Patent: Oct. 23, 2012

(54) TIME OF FLIGHT MASS SPECTROMETER AND CHARGED PARTICLE DETECTOR THEREFOR

(75) Inventors: Akio Suzuki, Hamamatsu (JP); Etsuo Iizuka, Hamamatsu (JP); Katsutoshi Nonaka, Hamamatsu (JP); Masahiro Hayashi, Hamamatsu (JP); Yuuya Washiyama, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 223 days.

(21) Appl. No.: 12/407,451

(22) Filed: Mar. 19, 2009

(65) Prior Publication Data

US 2009/0236517 A1 Sep. 24, 2009

(30) Foreign Application Priority Data

Mar. 21, 2008 (JP) ..... P2008-073871

(51) Int. Cl.
*H01J 49/40* (2006.01)

(52) U.S. Cl. ..... 250/287; 250/281; 250/282; 250/283; 250/286; 313/103 CM; 313/105 CM

(58) Field of Classification Search ..... 313/103 CM, 313/105 CM; 250/281, 282, 283, 284, 286, 250/287

See application file for complete search history.

(56) References Cited

U.S. PATENT DOCUMENTS

| | | | | | |
|---|---|---|---|---|---|
| 5,159,231 | A | * | 10/1992 | Feller et al. | 313/103 CM |
| 5,349,185 | A | * | 9/1994 | Mendenhall | 250/287 |
| 5,493,111 | A | * | 2/1996 | Wheeler et al. | 250/207 |
| 5,504,324 | A | * | 4/1996 | Armentrout | 250/214 VT |
| 5,581,151 | A | * | 12/1996 | Wheeler et al. | 313/541 |
| 5,719,623 | A | * | 2/1998 | Kinoshita | 348/215.1 |
| 5,770,858 | A | * | 6/1998 | Fuchs et al. | 250/287 |
| 2008/0230686 | A1 | | 9/2008 | Suzuki et al. | |

FOREIGN PATENT DOCUMENTS

| | | | |
|---|---|---|---|
| JP | 2001-503196 | | 3/2001 |
| JP | 2007-87885 | | 4/2007 |
| JP | 2007087885 | A * | 4/2007 |
| JP | 3132425 | | 5/2007 |
| WO | 99/38191 | | 7/1999 |

* cited by examiner

*Primary Examiner* — Michael Logie

(74) *Attorney, Agent, or Firm* — Drinker Biddle & Reath LLP

(57) ABSTRACT

In a charged particle detecting apparatus 100 for which an MCP is sandwiched with an IN electrode 1 and an OUT electrode and an anode electrode and a rear cover are installed therebehind, the component members in the rear of the IN electrode 1 are arranged further inside than the IN electrode 1 when viewed from an MCP incident surface, and the charged particle detecting apparatus 100 is fixed by screwing and the like to a cabinet wall surface 330 of a TOF-MS by using a flange portion provided at a part of IN electrode 1 projected further outside than the rear component members.

6 Claims, 20 Drawing Sheets

(a)

(b)

TIME OF FLIGHT MASS SPECTROMETER AND CHARGED PARTICLE DETECTOR THEREFOR

BACKGROUND OF THE INVENTION

1. Field of the Invention

The present invention relates to a time-of-flight mass spectrometry system for measuring the mass of sample ions based on the time of flight of an ionized sample to a detector, and a charged particle detecting apparatus to be used therefor.

2. Related Background Art

Time-of-flight mass spectrometry systems (TOF-MSs) that ionize samples and perform mass spectrometry based on differences in the flight time thereof have been known. As a typical TOF-MS, a spectrometer of the type disclosed in JP 2001-503196 A has been known.

In the TOF-MS, as shown in FIG. 19, a detector 100 is arranged at one end in a vacuum vessel 110, a sample 120 is arranged at the other end, and an electrode 130 having an opening is arranged between them. When the electrode 130 is grounded and a predetermined voltage is applied to the sample 120, ions emitted from the sample 120 are accelerated by an electric field formed between the sample 120 and the electrode 130, and collide with the detector 100. Because the acceleration energy to be given to the ions between the sample 120 and the electrode 130 is determined according to ion charge, the speed when ions pass through the electrode 130 depends on the mass of ions if the ion charge is the same. Between the electrode 130 and the detector 100, ions fly at a constant speed, so that the flight time of the ions therebetween is in inverse proportion to the speed. That is, the mass of ions can be determined by calculating the flight time therebetween.

As that detector 100, a detector of the type disclosed in JP3132425U, U.S. Pat. No. 5,770,858A, and JP2007-87885A. A basic equivalent circuit diagram is shown in FIG. 20. The detector 100 uses two disk-like microchannel plates (MCPs) 20 and 21 as an MCP group 2, and has a construction where an IN electrode 1 is arranged on its charged particle incident surface, an OUT electrode 3 is arranged on its exit surface, and the IN electrode 1 and the OUT electrode 3 sandwich the MCP group 2 therebetween. Behind the OUT electrode 3, an anode substrate 40 is arranged at a predetermined distance. In the detector 100 disclosed in these documents, a flange to be mechanically connected to the anode substrate 40 has been used to fix on a spectrometry system such as a TOF-MS.

SUMMARY OF THE INVENTION

In a TOF-MS, it is important for improving its mass resolution capability to further flatten the incident surface of the MCP group 2 of the detector 100 and maintain the same perpendicular to the ion beam axis of the system. However, according to the conventional construction, because a flange to be further mechanically connected to the anode substrate 40 has been used to fix the detector on the system body, a fine adjustment has been required for maintaining the incident surface of the MCP group 2 perpendicular to the above-described beam axis, and it has been difficult to secure the accuracy of the same.

It is therefore an object of the present invention to provide a TOF-MS improved in mass resolution capability by securing the accuracy of the incident surface of an MCP with respect to the ion beam axis of the system and a charged particle detecting apparatus to be used therefor.

In order to achieve the above-mentioned object, a charged particle detecting apparatus for a TOF-MS according to the present invention is a charged particle detecting apparatus arranged in a cabinet of a TOF-MS including an ion flying region and detecting ions that have flied through the ion flying region used therefore, the charged particle detecting apparatus includes a MCP, a first electrode arranged on a charged particle incident surface of the MCP, and having an opening to expose the charged particle incident surface of the MCP, a second electrode arranged on an electron exit surface of the MCP with the MCP sandwiched therebetween, and having an opening to expose the electron exit surface of the MCP, a third electrode arranged opposing the exit surface of the MCP with the second electrode sandwiched therebetween, and a rear cover arranged on a surface of the third electrode opposite to a surface opposing the MCP, wherein the first electrode comprises a flange portion to be fitted to the cabinet, and the flange portion is provided in a manner projecting further outside than the components arranged between the rear cover and the first electrode including the rear cover when viewed from the charged particle exit surface side of the MCP. Moreover, a TOF-MS according to the present invention includes such charged particle detecting apparatus.

More specifically, according to the present invention, a charged particle detecting apparatus includes in its first electrode a flange portion to be fixed to a cabinet. It is preferable to arrange an insulator between the flange portion and the cabinet. In addition, it is preferable to include an electrically insulating screw member for fixing the flange portion to the cabinet.

It is preferable that the charged particle detecting apparatus is fixed with a surface of the flange portion facing the MCP or a face opposite thereto facing a fixing wall surface provided on the cabinet.

Although the MCP of a TOF-MS according to the present invention is fixed while being sandwiched with the first electrode and the second electrode, because the charged particle detecting apparatus including the MCP has been fixed to the cabinet of the TOF-MS using the flange portion provided in the first electrode, members interposed between the MCP incident surface and the mount surface of the cabinet are reduced in number, which makes it easy to maintain positional accuracy of both, so that the accuracy of the incident surface of the MCP with respect to the ion beam axis of the system can be secured, and thus as a result, mass resolution capability is improved.

When there is a potential difference between the cabinet for which mounting is performed and the first electrode, it is preferable to provide therebetween an insulator.

DESCRIPTION OF THE PREFERRED EMBODIMENTS

Figure 1:
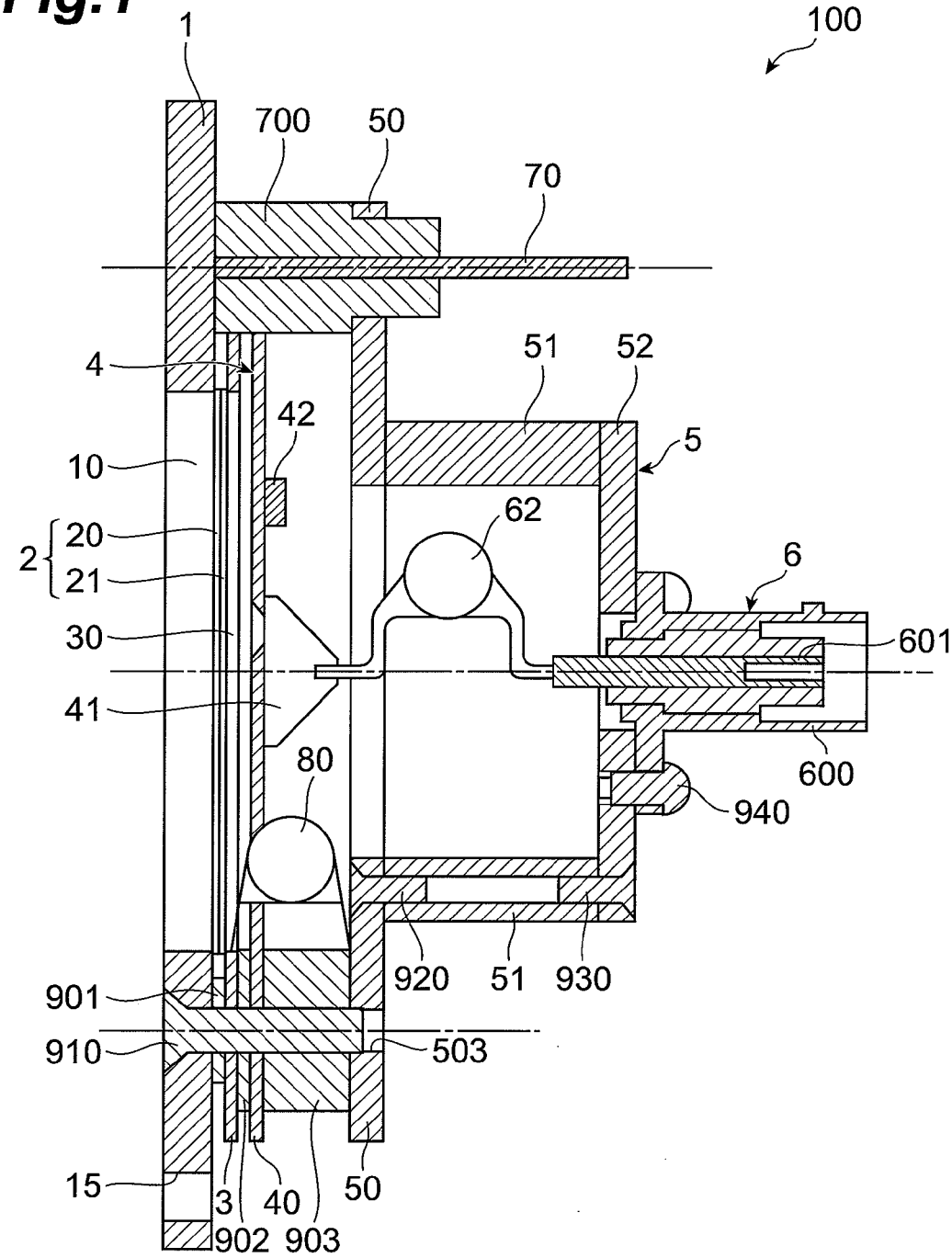
FIG. 1 is a sectional view showing an embodiment of a charged particle detecting apparatus to be used for a TOF-MS according to the present invention.

Hereinafter, preferred embodiments of the present invention will be described in detail with reference to the accompanying drawings. To facilitate the comprehension of the explanation, the same reference numerals denote the same parts, where possible, throughout the drawings, and a repeated explanation will be omitted.

Figure 2:
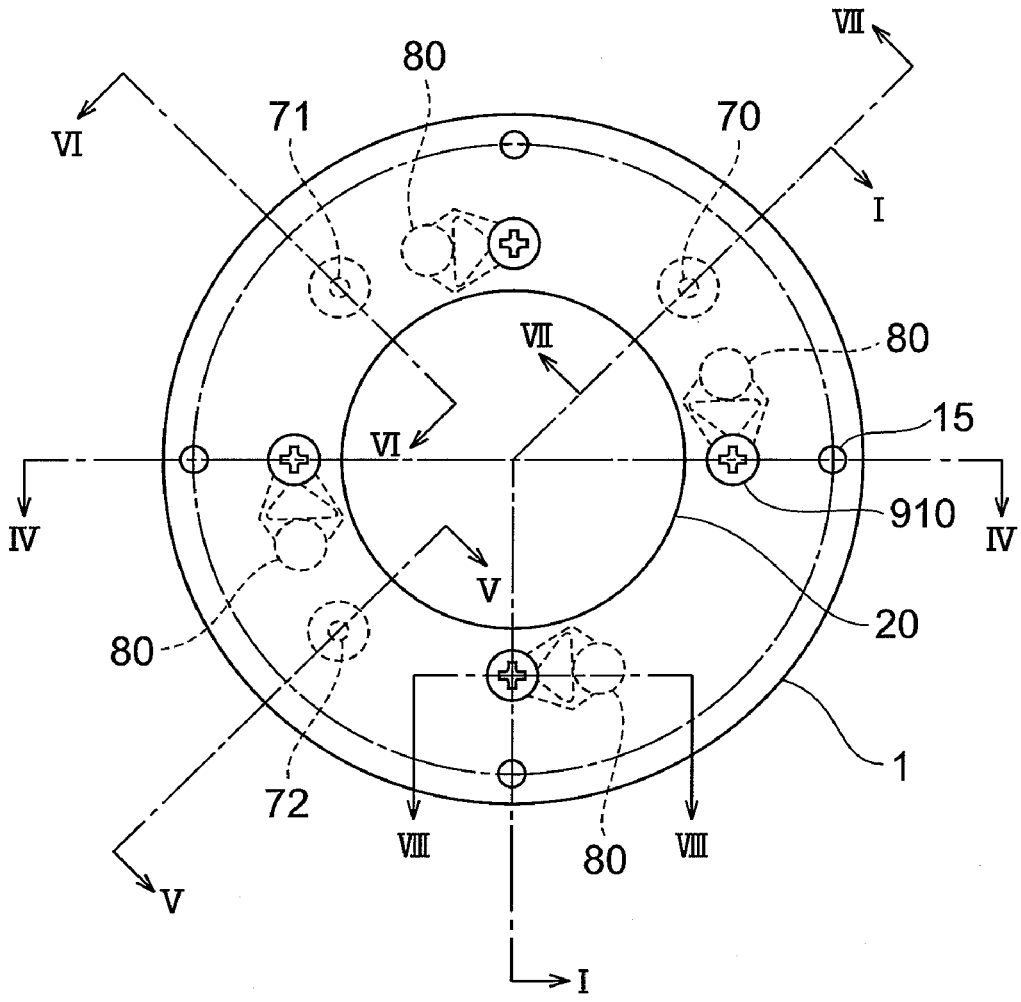
FIG. 2 and FIG. 3 are a front view and a back view thereof, respectively.
Figure 3:
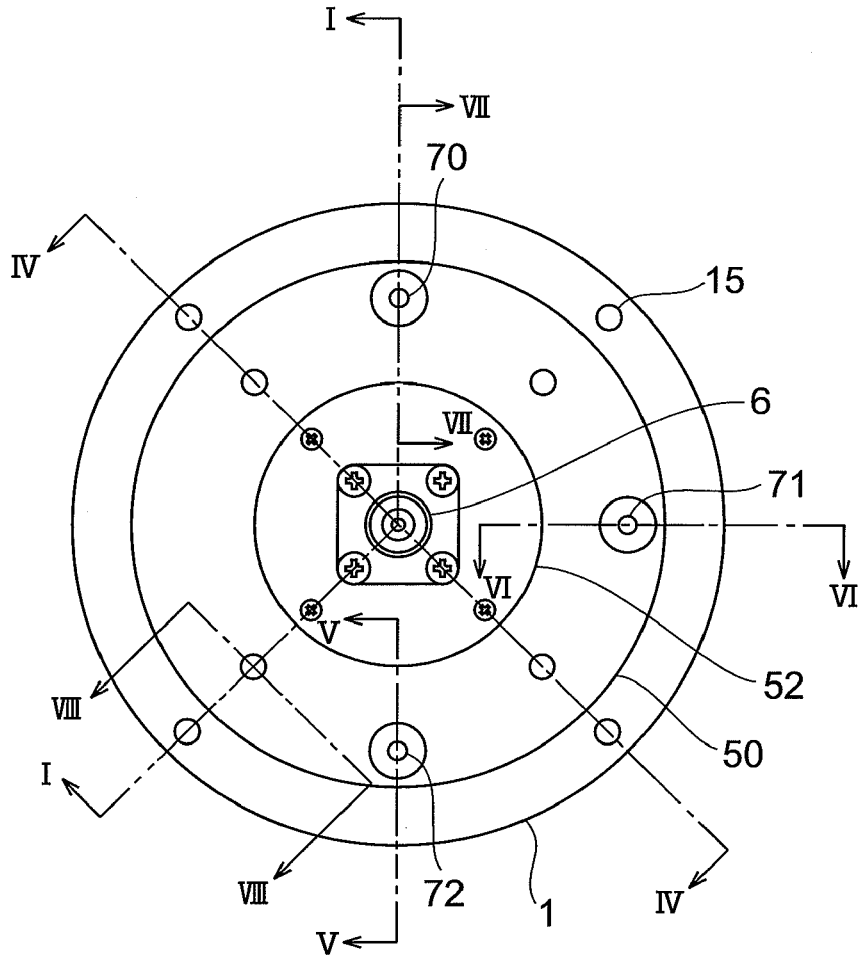
Figure 4:
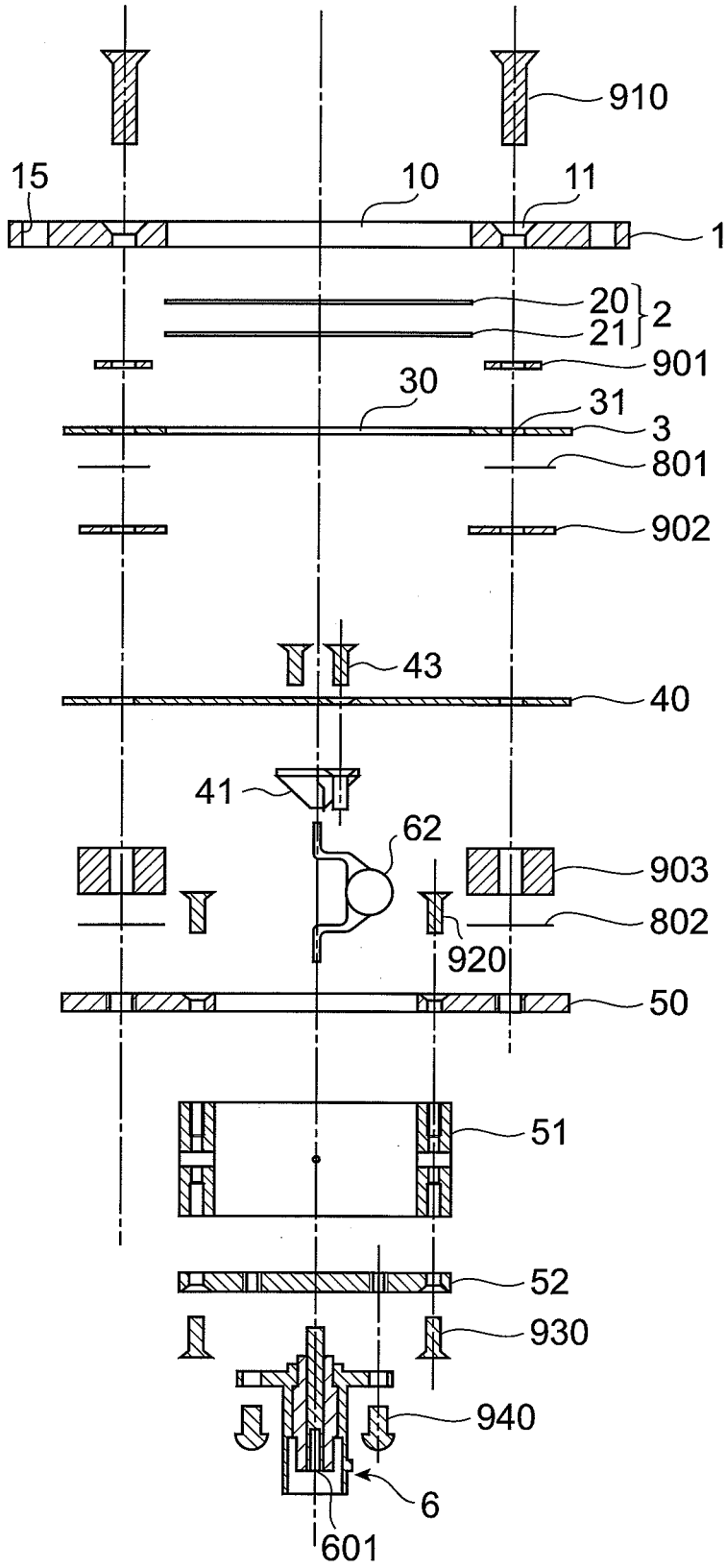
FIG. 4 to FIG. 8 are exploded sectional views along a line IV-IV, a line V-V, a line VI-VI, a line VII-VII, and a line VIII-VIII in FIG. 2 and FIG. 3, respectively.
Figure 5:
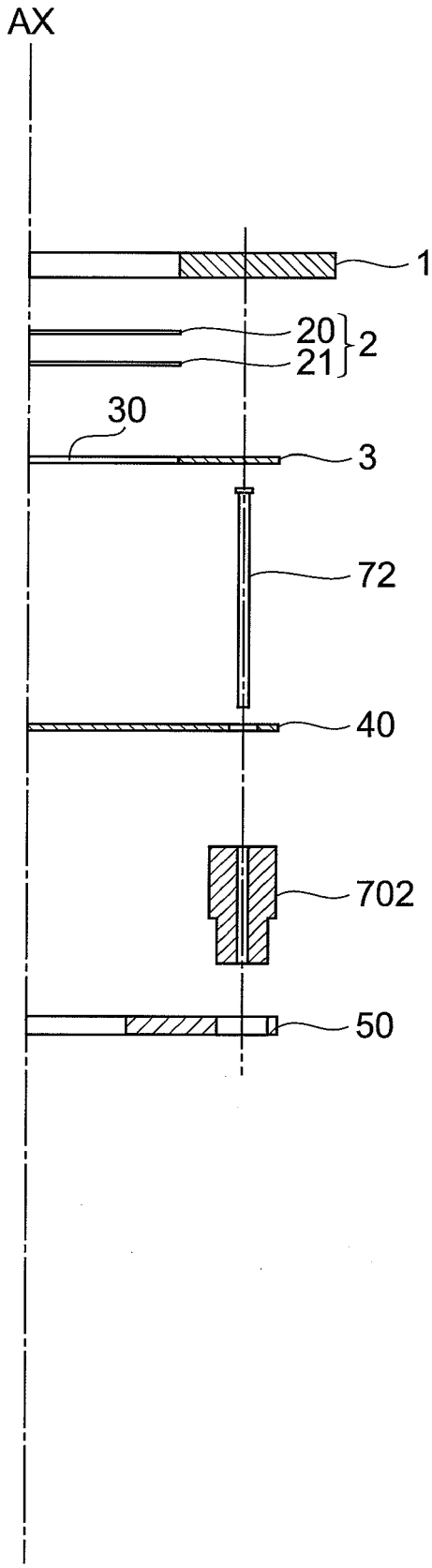
Figure 6:
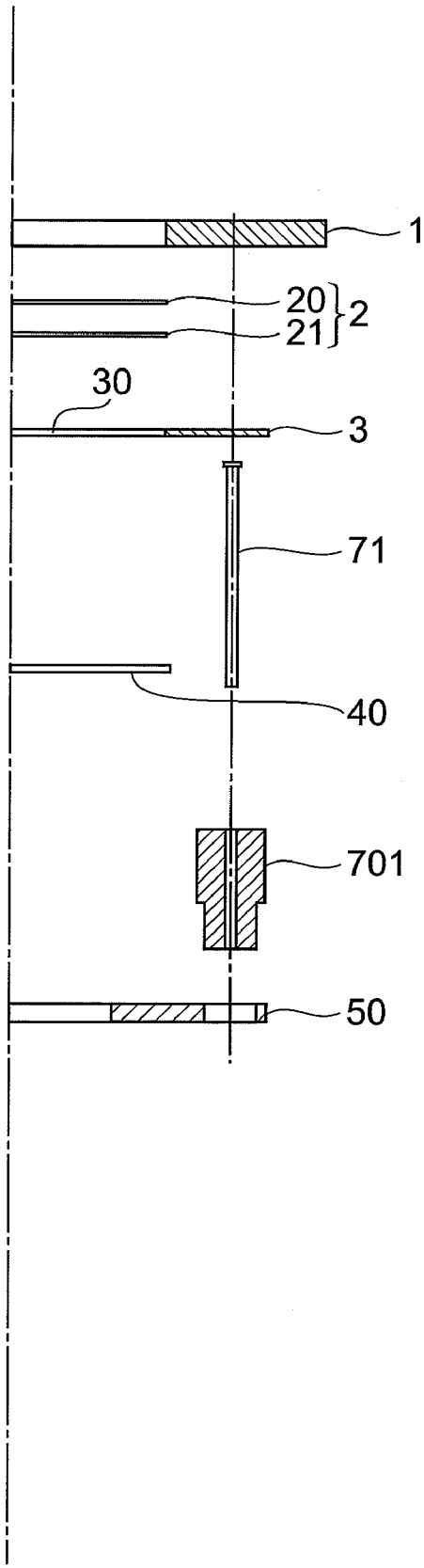
Figure 7:
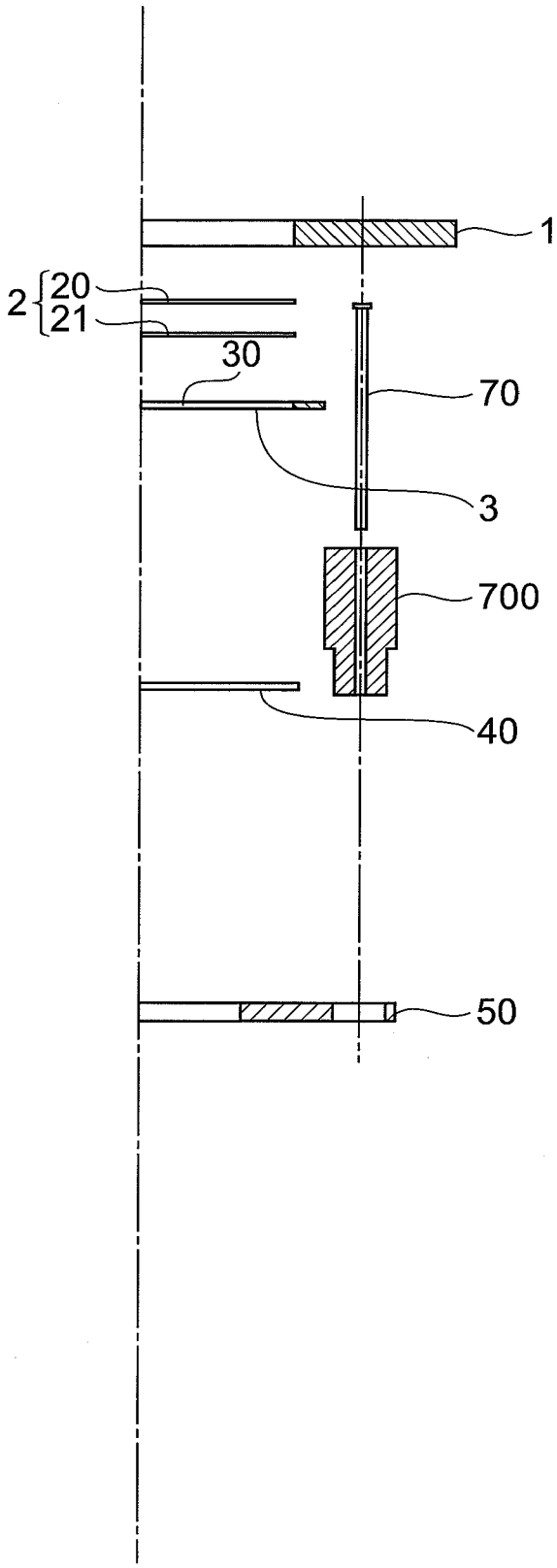
Figure 8:
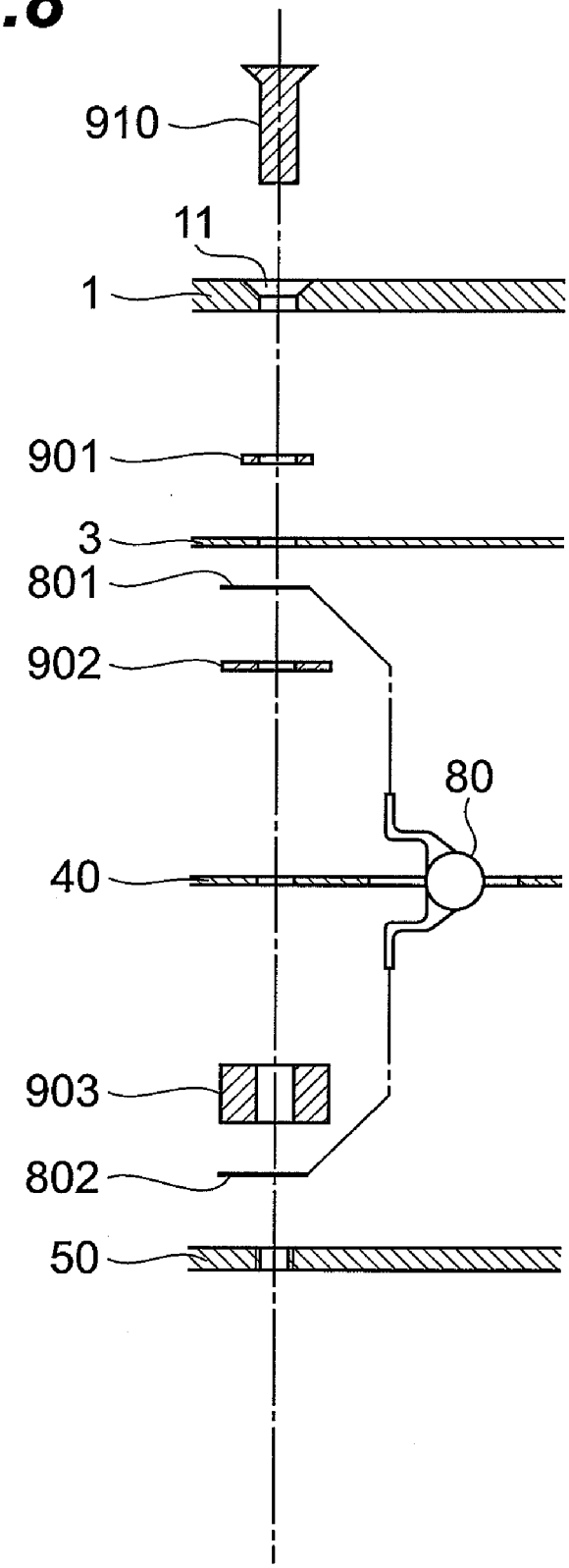

FIG. 1 is a sectional view showing an embodiment of a charged particle detecting apparatus to be used for a TOF-MS according to the present invention, FIG. 2 is a front view thereof, and FIG. 3 is a back view thereof. FIG. 4 to FIG. 8 are exploded sectional views along a line IV-IV, a line V-V, a line VI-VI, a line VII-VII, and a line VIII-VIII in FIG. 2 and FIG. 3, respectively.

The detecting apparatus 100, in which two disk-like MCPs 20 and 21 are used as an MCP group 2, has a construction where an IN electrode (first electrode) 1 is arranged on its charged particle incident surface (front surface), an OUT electrode (second electrode) 3 is arranged on its exit surface (rear surface), and the IN electrode 1 and the OUT electrode 3 sandwich the MCP group 2 therebetween.

The IN electrode 1 is a metal-made (for example, stainless steel-made) electrode in a doughnut shape having an opening 10 at its center, and in its disk surface, holes 11 into which four flat head screws 910 are inserted are formed every 90 degrees with respect to the axis center. In the periphery of the IN electrode 1, a hole 15 into which a screw is inserted when fixing the present detecting apparatus 100 to a cabinet of a TOF-MS is formed. To the rear surface of the IN electrode 1, a conductive (for example, stainless steel-made) and rod-like IN lead 70 extending from the rear side is electrically connected. The connecting position thereof is to be located midway between two adjacent holes 11. The IN lead 70 is retained while being inserted in an insulating IN lead insulator 700, and is insulated from other components. As the IN lead insulator 700, for example, a PEEK (PolyEtherEtherKetone) resin excellent in workability, heat resistance, impact resistance, and insulation performance is preferably used.

The OUT electrode 3 is also similarly a metal-made electrode in a doughnut shape having an opening 30 at its center, however, this has a structure partially cut away so as not to come into contact with the IN lead insulator 700 housing the IN lead 70. Similar holes 31 are formed at positions of the disk surface corresponding to the holes 11 of the IN electrode 1. To the rear surface of the OUT electrode 3, a conductive (for example, stainless steel-made) and rod-like OUT lead 71 extending from the rear side is electrically connected. The OUT lead 71 is arranged at a position rotated counterclockwise by 90 degrees with respect to the axis center from the IN lead 70 when viewed from the front. This OUT lead 71 is also, similar to the IN lead 70, retained while being inserted in an insulating, for example, PEEK resin-made OUT lead insulator 701, and is insulated from other components.

At positions corresponding to the holes 11 and 31 sandwiched between the IN electrode 1 and the OUT electrode 3, insulating MCP insulators 901 in doughnut shapes are arranged, respectively. These MCP insulators 901 are made of, for example, a PEEK resin, and formed to be slightly smaller in thickness than the MCP group 2. This construction allows, when the IN electrode 1 and the OUT electrode 3 sandwich MCP group 2 therebetween, accurately assembling these so that the centers of the MCPs 20 and 21 in disk shapes match with the centers of the openings 10 and 30 of the IN electrode 1 and the OUT electrode 3.

Behind the OUT electrode 3, an anode substrate 40 is arranged at a predetermined distance. This anode substrate 40 is a substrate for which predetermined patterns of metal thin films made of copper or the like are formed on the front and back surfaces of a disk molded from a glass epoxy resin, and the patterns on the front and back surfaces are made to conduct to each other. The anode substrate 40 has a structure partially cut away so as not to come into contact with the IN lead insulator 700 housing the IN lead 70 and the OUT lead insulator 701 housing the OUT lead 71. In addition, because being arranged at the distance as described above, the anode substrate 40 is provided with holes at positions corresponding to the holes 11 and 31, and arranged between the anode substrate 40 and the OUT electrode 3 is a conductive thin plate 801 and an insulating insulator 902 both being in doughnut shapes. As the thin plate 801, a member excellent in ductility is preferably used, and for example, a member obtained by plating gold or copper on a phosphor bronze plate is preferably used. As the insulator 902, for example, a PEEK resin can be used.

Of the patterns formed on the front and back surfaces of the anode substrate 40, the pattern on the front surface is in a circular shape, which matches in shape with the opening 30 of the OUT electrode 3, and the opening 30 and the pattern on the front surface are arranged coaxially. On the other hand, the pattern on the back surface is an almost linear pattern extending to one side of the radial direction from the center of the anode substrate 40, and to its outer end, a conductive (for example, stainless steel-made) and rod-like anode lead 72 extending from the rear side is electrically connected. The anode lead 72 is arranged at a position rotated counterclockwise by 90 degrees with respect to the axis center from the OUT lead 71 when viewed from the front. That is, the anode lead is arranged at a position symmetrical to the IN lead 70 with respect to the axis center. This anode lead 72 is also, similar to the IN lead 70 and the OUT lead 71, retained while being inserted in an insulating, for example, a PEEK resin-made anode lead insulator 702, and is insulated from other components.

To the center of the pattern on the back surface, an anode terminal 41 made of copper is connected by a screw 43. This anode terminal 41 and the anode substrate 40 constitute the anode electrode (third electrode) 4. On the pattern on the back surface, a chip resistor 42 is arranged.

Behind the anode electrode 4, a rear cover 5 is arranged. This rear cover 5 consists of a doughnut-shaped substrate 50, a circular cylindrical portion 51, and a substrate 52 in a doughnut shape likewise, and is formed as a deep dish-shaped member by connecting the inner periphery of the substrate 50 and the outer periphery of the substrate 52 by means of the cylindrical portion 51 that is sandwiched between the substrates 50 and 52 and fixed by screws 920 and 930. The substrates 50 and 52 and the circular cylindrical portion 51 are all made of metal (for example, stainless steel), the substrate 50 is provided with a screw hole 503, and the rear cover 5 is arranged on the back surface of the anode electrode 4 with an insulator 903 and a thin plate 802 sandwiched therebetween and the screws 910 are tightened into the screw hole 503, thereby fixing the electrodes 1, 3, and 4 and the MCP group 2 to the rear cover 5. As the thin plate 802, the same member as that of the thin plate 801 is preferably used. For the insulator 903, for example, a PEEK resin can be used. The substrate 50 has holes into which the lead insulators 700 and 702 are inserted, respectively.

To the center of the substrate 52, a BNC terminal 6 being a signal output part is connected by a screw 940. The outer side 600 of the BNC terminal 6 is electrically connected to the substrate 50 of the rear cover 5. On the other hand, a core 601 inside the BNC terminal 6 is connected to the anode terminal 41 via a capacitor (first capacitor) 62. This capacitor 62 also has a function of adjusting a signal output level to the GND level by insulating the output.

In addition, between the above-described thin plates 801 and 802, capacitors (second capacitors) 80 are connected. Four capacitors 80 in total are mounted at equal intervals in the circumferential direction. These capacitors 80 are attached between the substrate 50 and the OUT electrode 3.

Here, in the IN electrode 1, the surface opposite to a surface opposing the MCP group 2 and the side surface are entirely exposed, the members (the MCP group 2, the OUT electrode 3, and the anode electrode 4) arranged between the IN electrode 1 and the rear cover 5 including the rear cover 5 are all smaller in outer diameter than the IN electrode 1, and other members (capacitors 62 and 80, etc.) are also arranged so as to be located further inside than the side wall of the IN electrode 1 when viewed from the front (IN electrode 1 side, in the charged particle incident direction). Among the component members, only the IN electrode 1 projects further outside than the side wall of the substrate 50 of the rear cover 5, and the above-mentioned hole 15 is formed in the projected part. This projected part corresponds to a flange portion to be described later.

Figure 20:
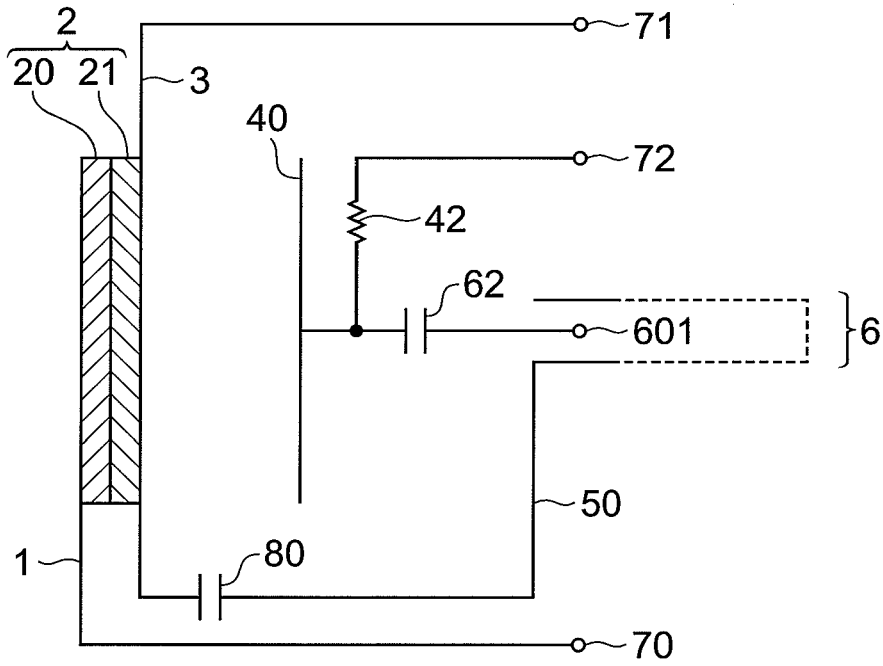
FIG. 20 is an equivalent circuit diagram of a detecting apparatus.

The present detecting apparatus 100 has the same circuit as that of the equivalent circuit diagram shown in FIG. 20. At the time of measurement, potential at both the core 601 side and outer side of the BNC terminal 6 are set to the ground potential, and for anion measurement, positive voltage is applied to the leads 70 to 72. At this time, the voltages V1 to V3 to be supplied to the leads 70 to 72, respectively, have a relationship of $0<V1<V2<V3$. Conversely, for cation measurement, negative voltage is applied to the leads 70 to 72. At this time, the voltages V1 to V3 to be supplied to the leads 70 to 72, respectively, have a relationship of $V1<V2<V3<0$. The potential difference of $V2-V1$, $V3-V2$ is set to the same value between the time of anion measurement and the time of cation measurement.

Figure 9:
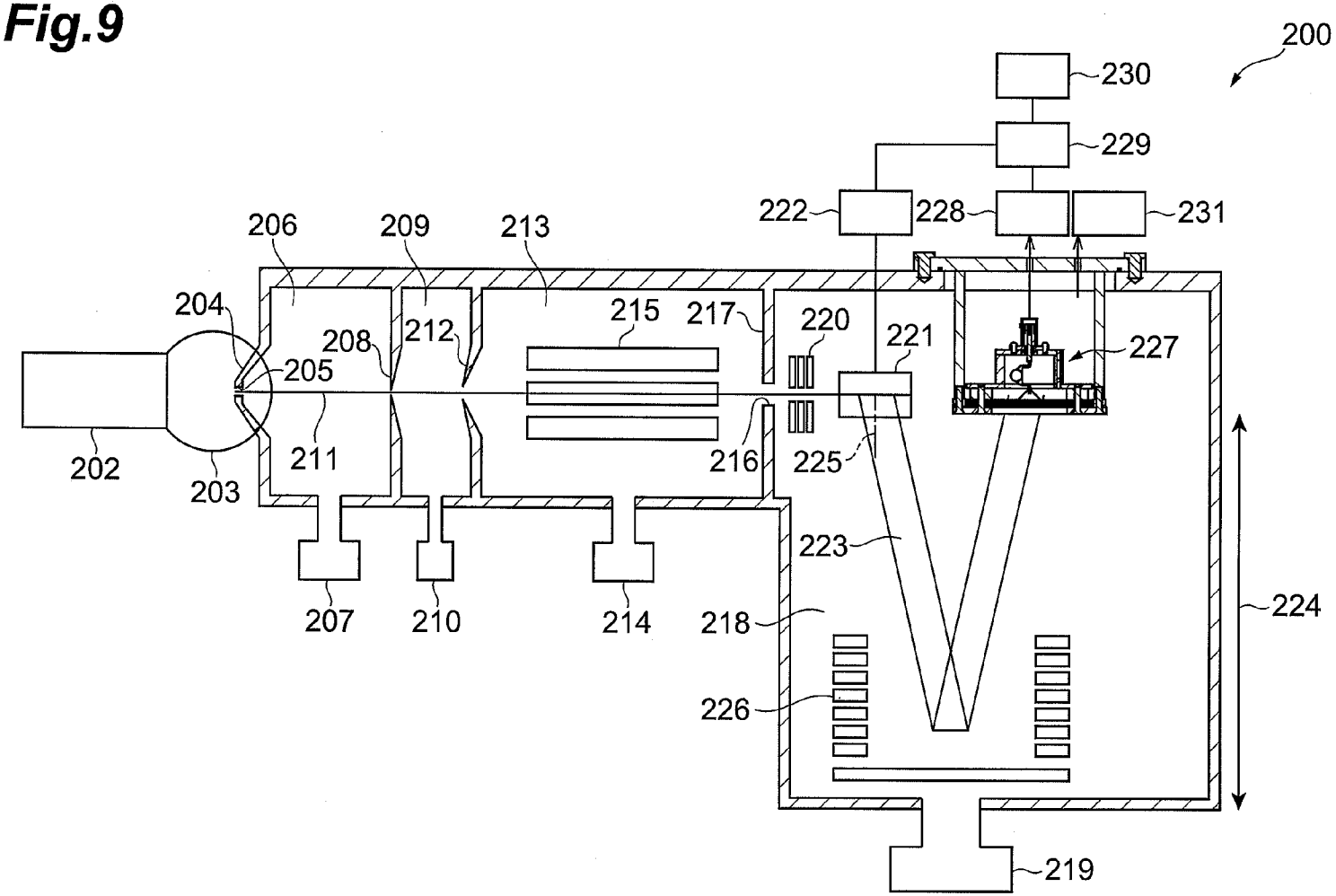
FIG. 9 is a schematic view of a TOF-MS adopting the charged particle detecting apparatus of FIG. 1 as its detector.

FIG. 9 is a schematic view of a TOF-MS 200 adopting the charged particle detecting apparatus as its detector 227.

The TOF-MS 200 has a construction where four decompression chambers 206, 209, 213, and 218 maintained in a vacuum state are connected, and each decompression chamber 206, 209, 213, 218 includes a pump 207, 210, 214, 219. At a pre-stage of the first decompression chamber 206, a high-frequency inductively coupled thermal plasma (ICP) torch 202 for forming plasma of a sample is arranged with a sampling cone 204 having an orifice 205 on its point sandwiched therebetween, and plasma 203 generated therein is guided into the first decompression chamber 206 from the orifice 205.

The first decompression chamber 206 and the following second decompression chamber 209 are connected by a skimmer 208. The second decompression chamber 209 and the following third decompression chamber 213 are connected with a conical extraction lens 212 sandwiched therebetween. In the third decompression chamber 213, a hexapole rod assembly 215 for guiding ions transformed into plasma into the following fourth decompression chamber 218 is arranged. The third decompression chamber 213 and the fourth decompression chamber 218 are partitioned with a wall portion 217 and connected by an orifice 216.

Ions unique to the sample are generated in the plasma 203 generated by the ICP torch 202, and the ions pass on an axial line 211 and are guided into the fourth decompression chamber 218. In the fourth decompression chamber 218, an electrostatic focusing lens 220 and an ion propeller 221 are arranged on the axial line 211, an electrostatic ion mirror 226 is arranged at the lower end opposing the ion propeller, and an ion detector 227 is arranged at the upper end opposing the same. The ion propeller 221 is caused to emit sample ions in a pulsed manner by a pulse generator 222, and the ions reach the ion detector 227 while flying on a trajectory 223 as a result of being reflected by the electrostatic ion mirror 226. A region 224 where ions fly is called a drift region. The ion detector 227 is connected with an amplifier 228 and a high-voltage supply source 231, and these are connected to a clock generator 229 to control operation of the pulse generator 222. As a controller of the system, a digital computer 230 is used.

In the system, it is important for an improvement in mass resolution to maintain perpendicularity of the input surface of the detector 227 and the surface of the system to be fixed with the detector 227 with respect to an axial line 225.

Figure 10:
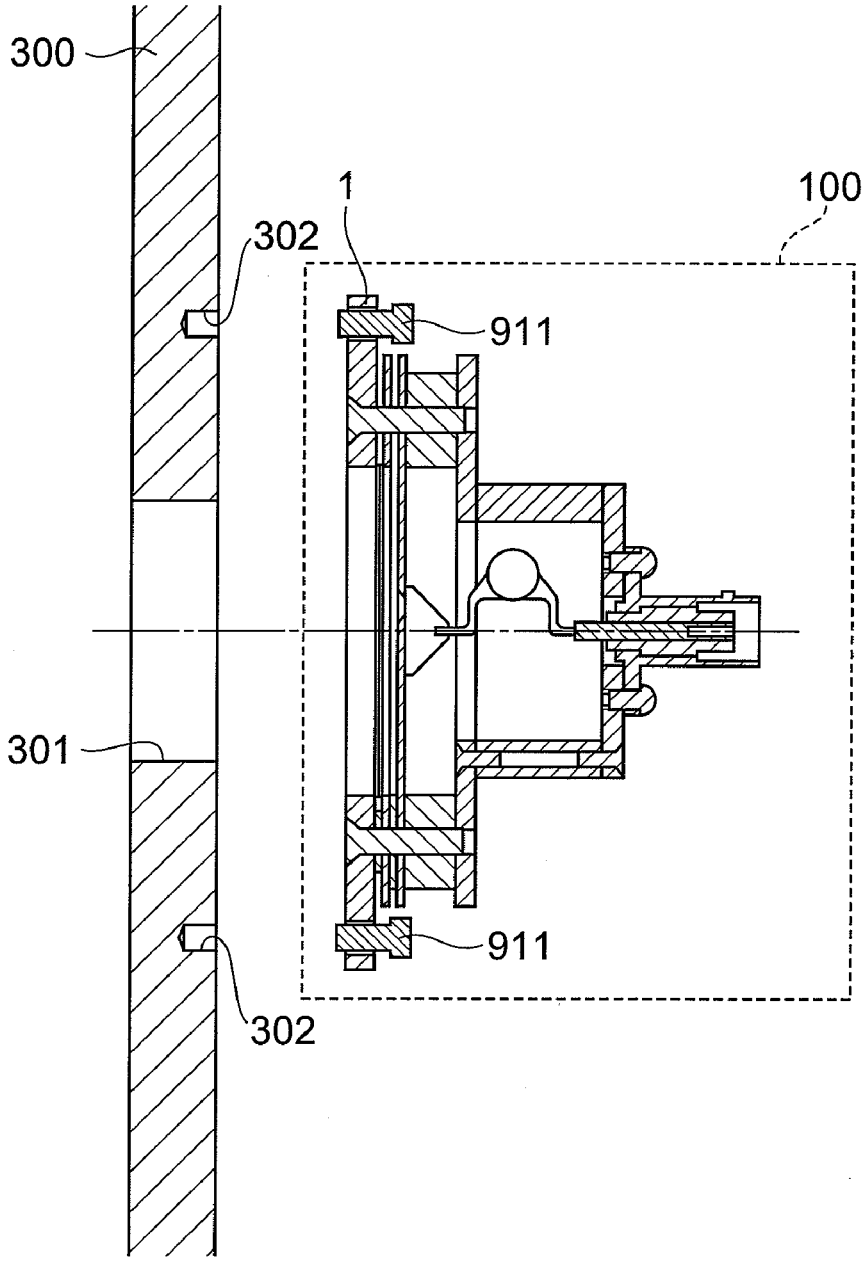
FIG. 10 and FIG. 11 are views each showing a fixing status of the charged particle detecting apparatus of FIG. 1 to a TOF-MS case.

FIG. 10 is a view showing a fixing condition of the above-described detector 100 to a TOF-MS cabinet. In the embodiment shown in FIG. 10, by fixing a screw 911 inserted into and passed through a hole (the above-described hole 15) provided in the flange portion on the periphery of the IN electrode 1 of the detector 100 into a screw hole 302 provided in a cabinet wall surface 300, fixation of the detector 100 to the cabinet is performed. In this embodiment, charged particles that have passed through a hole 301 of the cabinet are detected by the detector 100. In the present embodiment, by securing parallelism of both surfaces of the IN electrode 1 in advance, parallelism between the cabinet wall surface 300 with predetermined positional accuracy with respect to the ion flying region and the MCP incident surface of the detector 100 can be secured. As a result, it is made easy to maintain the MCP incident surface perpendicular to a desired axial line, which is useful for improving mass resolution.

Figure 11:
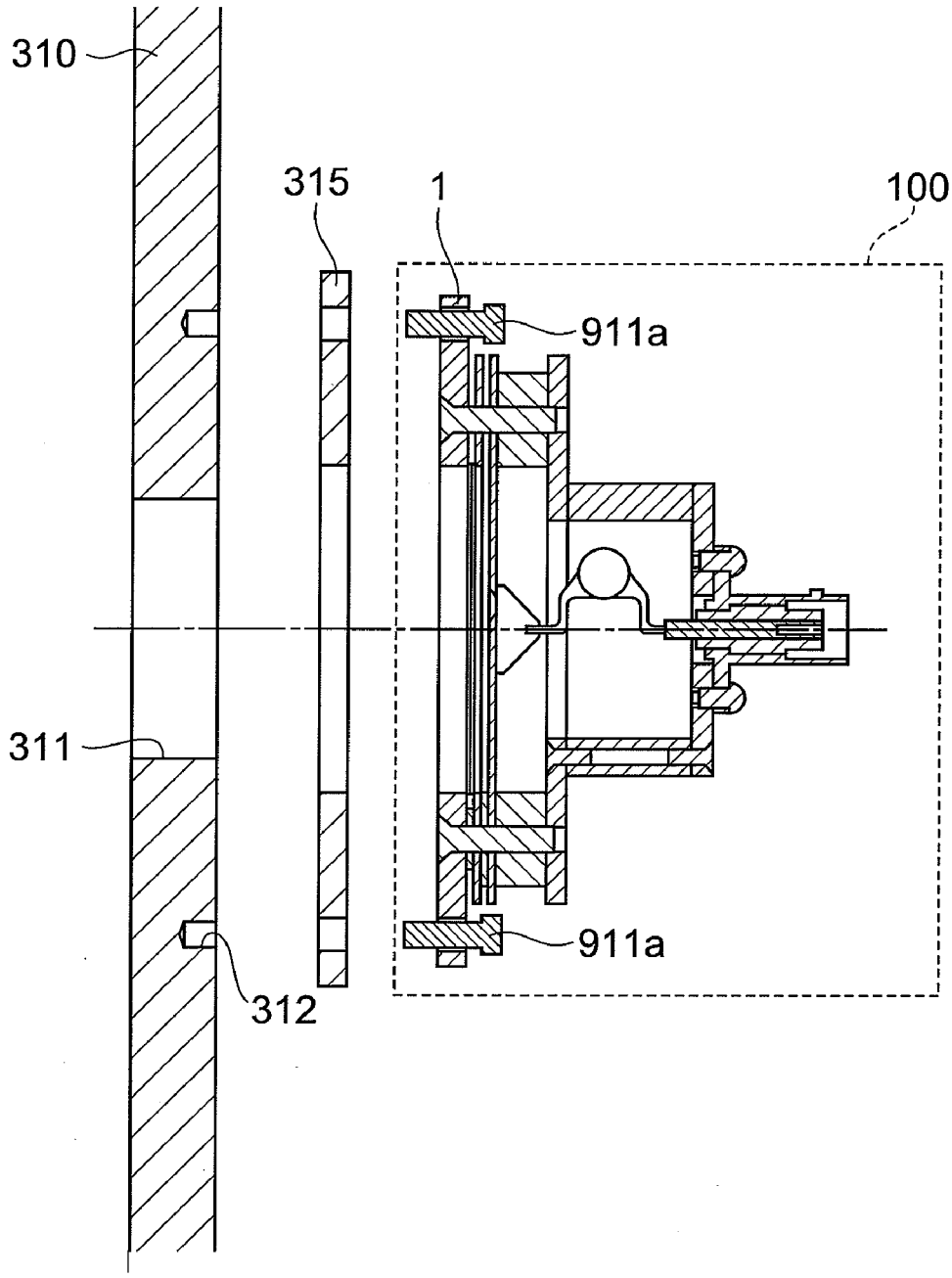
Figure 12:
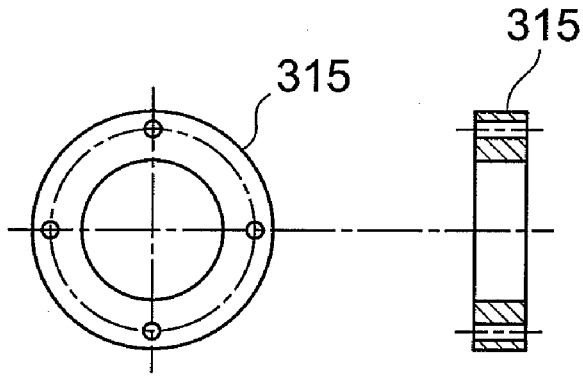
FIG. 12 are views each showing an insulator to be used when fixing the charged particle detecting apparatus of FIG. 1 to a TOF-MS case.
Figure 12:
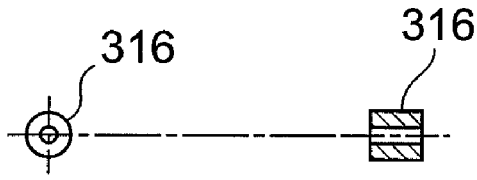

FIG. 11 is a view showing a different aspect of the fixing method to a TOF-MS cabinet. In this embodiment, there is a difference in the point of arranging a ring 315 formed of an insulator between a cabinet wall surface 310 and the flange portion on the periphery of the IN electrode 1 of the detector 100, and the point of fixing a screw 91 la that has passed through the IN electrode 1 into a screw hole 312 provided in the cabinet wall surface 310 to thereby perform fixation of the detector 100 to the cabinet is common. FIG. 12(*a*) shows a shape of the ring 315, which has a circular opening through which charged particles pass in its center, and in the ring body, a hole through which the screw 911*a* penetrates is provided. In place of the ring 315, as shown in FIG. 12(*b*), a circular cylindrical spacer 316 having in its center a hole through which a screw 911*a* penetrates may be arranged in a manner corresponding to each screw 911*a*. In this case, an insulator such as PEEK is used for the screw 911*a*. When there is a potential difference between the IN electrode 1 and the cabinet wall surface 310, it is preferable to provide therebetween an insulator as such.

Figure 13:
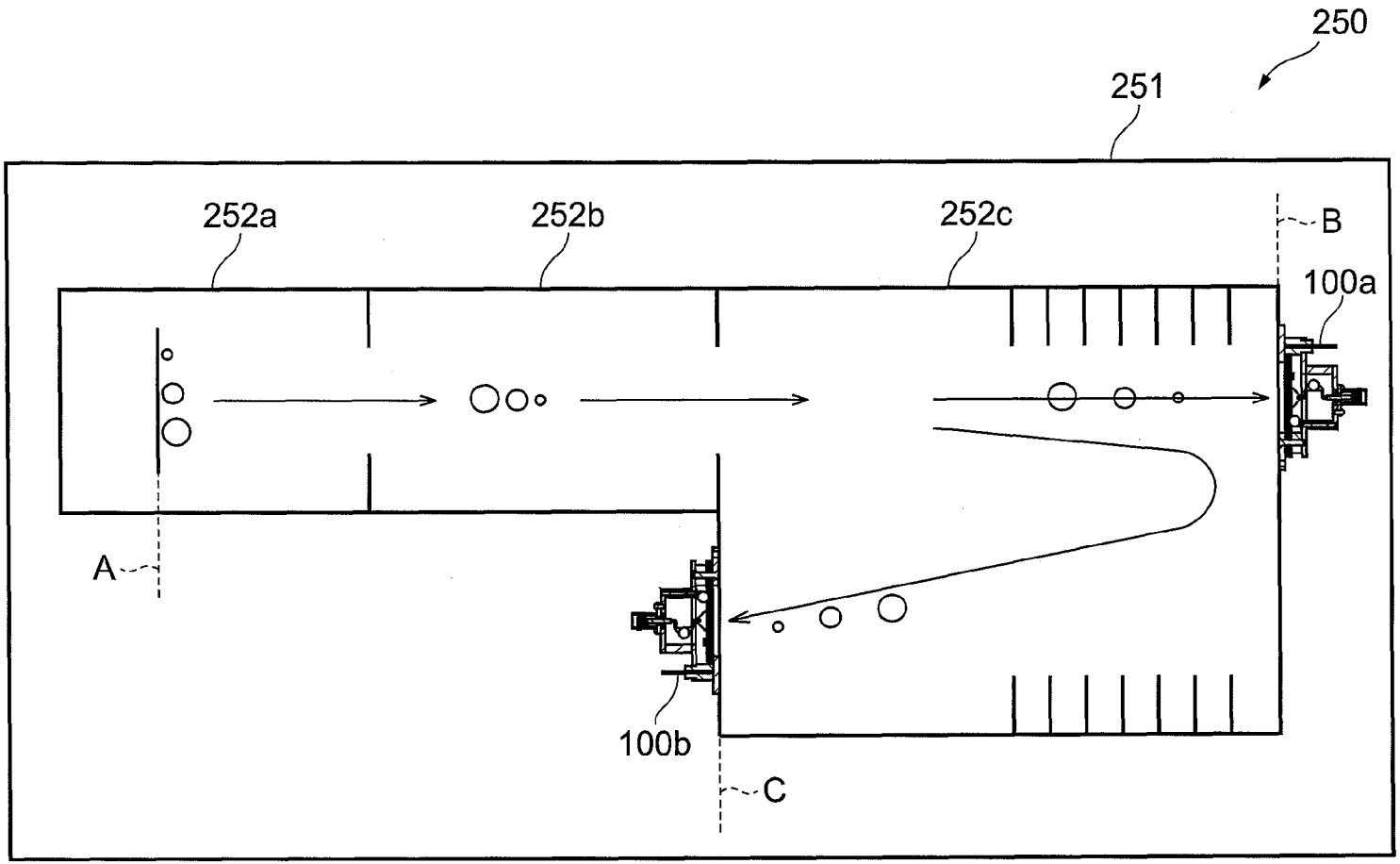
FIG. 13 is a schematic view of a TOF-MS mounted with the charged particle detecting apparatus of FIG. 1.

FIG. 13 is a schematic view of a TOF-MS mounted with the detector 100 according to the method of FIG. 10 or FIG. 11. A cabinet 251 that forms a vacuum vessel of the TOF-MS 250 is internally divided into three chambers 252*a*, 252*b*, and 252*c*, where a sample is arranged on a sample plane A, and while ions that have proceeded along an axial line therefrom are detected by a linear detector 100*a*, ions reversed here are detected by a reflectron detector 100*b*. In the case of this construction, retaining each parallelism between the sample plane A and a mount surface B of the linear detector 100*a* and between the sample plane A and a mount surface C of the reflectron detector 100*b* makes it easy to maintain the accuracy of the incident surface of each detector 100*a*, 100*b*.

Figure 14:
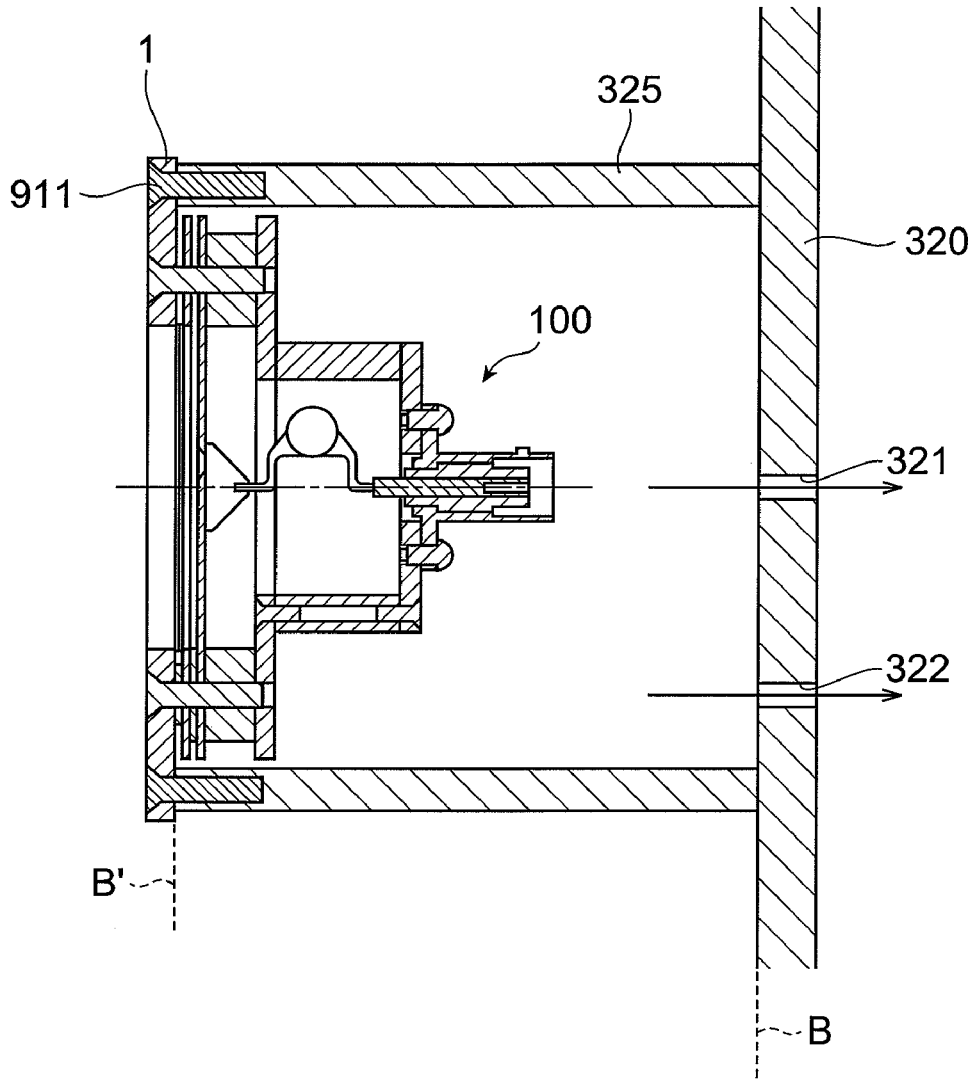
FIG. 14 and FIG. 15 are views showing different aspects of fixing status of the charged particle detecting apparatus of FIG. 1 to a TOF-MS case.

FIG. 14 is a view showing a different embodiment of fixation of the detector 100 to a TOF-MOS cabinet. In this embodiment, there is a difference from the embodiment shown in FIG. 10 in the point of fixing the detector 100 with its charged particle incident surface facing in the direction opposite to a cabinet wall surface 320. From the cabinet wall surface 320, a circular cylindrical or square cylindrical fixing wall 325 with predetermined positional accuracy with respect to the ion flying region is projected, the detector 100 is stored within the same, and the detector 100 is fixed by screwing the screw 911 that has penetrated through the IN electrode 1 into a screw hole provided at the front end of the fixing wall 325. In the cabinet wall surface 320, holes 321 and 322 to pass therethrough a cable for supplying the detector 100 with power and a signal output cable are provided. When preparing the cabinet, manufacturing this with accuracy of parallelism between a surface B of the cabinet wall surface 320 and a front end face B' of the fixing wall 325 makes it easy to retain the MCP incident surface perpendicular to a desired axial line, which is useful for improving mass resolution.

Figure 15:
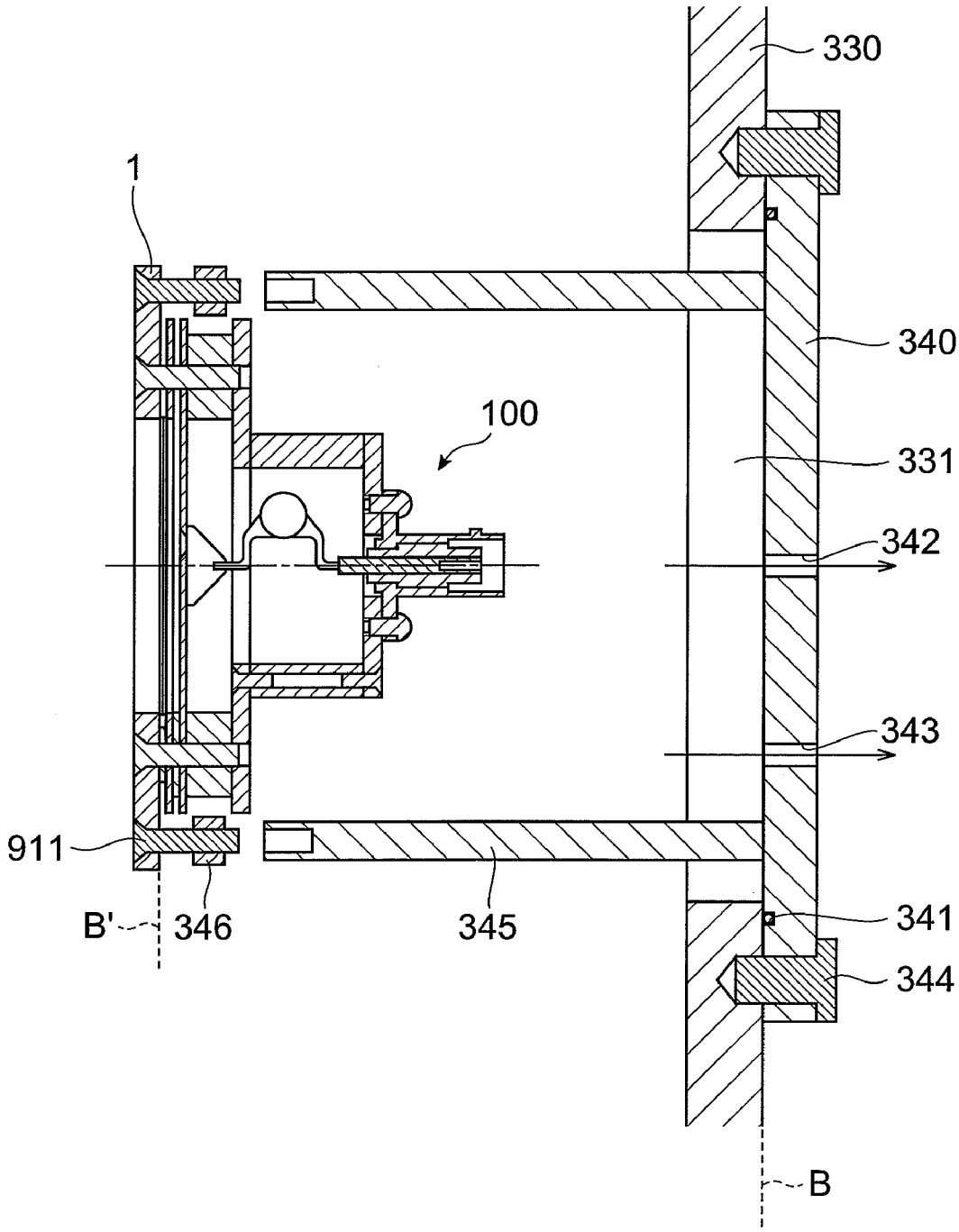

FIG. 15 is a view showing a still different embodiment of fixation of the detector 100 to a TOF-MOS cabinet. In this embodiment, there is a difference in the point of, unlike the embodiment of FIG. 14, using a spacer 346 as shown in FIG. 12(*b*) when fixing the detector 100 to a fixing wall 345, and in the point of, without the fixing wall 345 directly projecting from a cabinet wall surface 330, providing a circular plate-shaped or a rectangular plate-shaped flange wall 340 projecting further outside than the side wall of the fixing wall 345 while being fixed to the end face of the opposite side of the fixing wall 345 and fixing this to the cabinet wall surface 330 by screwing with a screw 344. Here, a seal 341 is provided between the flange wall 340 and the cabinet wall surface 330 to thereby prevent the air from intruding between the flange 340 and the cabinet wall surface 330 and degrading the vacuum. Also in this embodiment, the same effect as that of the detector of FIG. 14 can be obtained. Further, replacement and maintenance of the detector 100 are made easy. These three chambers 252*a*, 252*b*, and 252*c* constitute a vacuum vessel.

Figure 16:
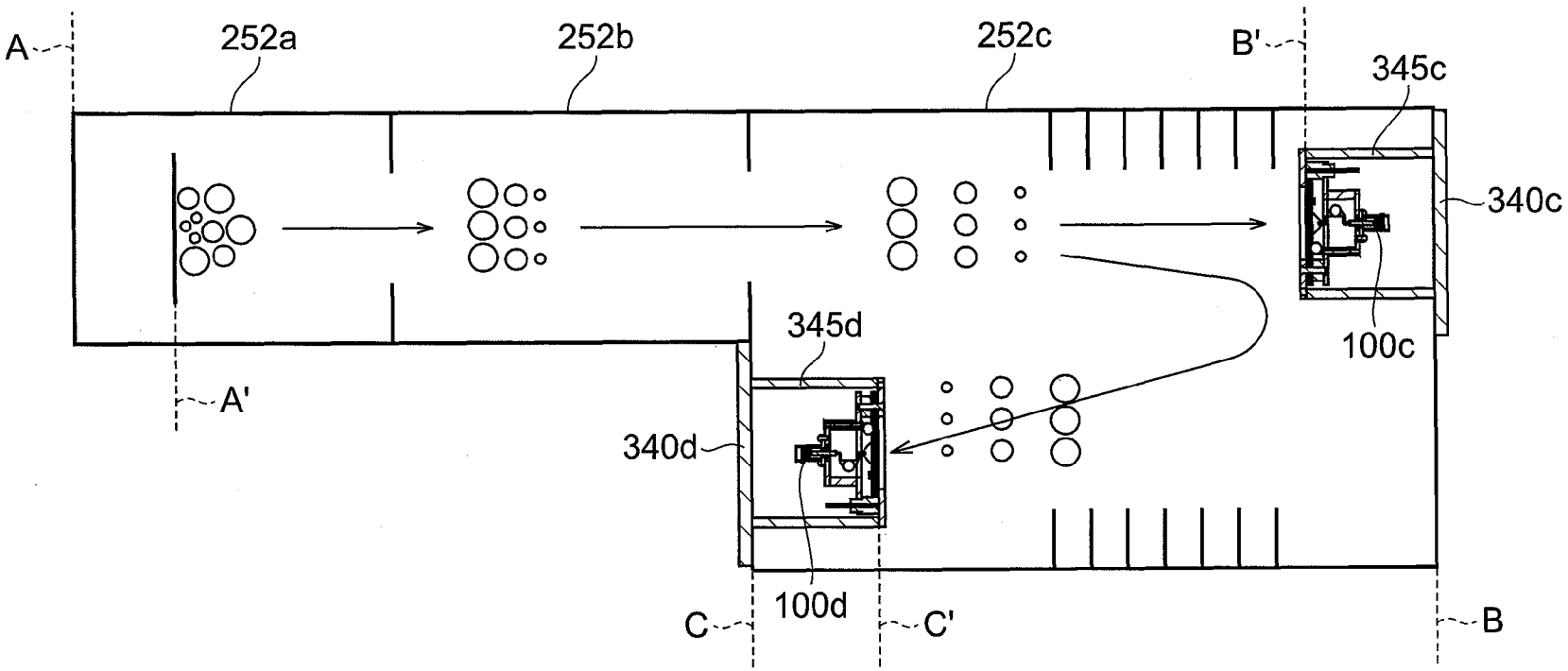
FIG. 16 to FIG. 18 are schematic views of TOF-MSs in other embodiments mounted with the charged particle detecting apparatus of FIG. 1.

FIG. 16 is a schematic view of a TOF-MS mounted with the detector 100 by the method of FIG. 14 or FIG. 15. The cabinet itself has the same construction as that of the TOF-MS shown in FIG. 13. In the case of this construction, retaining each parallelism between sample planes A and A' and mount surfaces B and B' of a linear detector 100*c* and between the sample plane A and mount surfaces C and C' of a reflectron detector 100*d* makes it easy to maintain the accuracy of the incident surface of each detector 100*c*, 100*d*.

Figure 17:
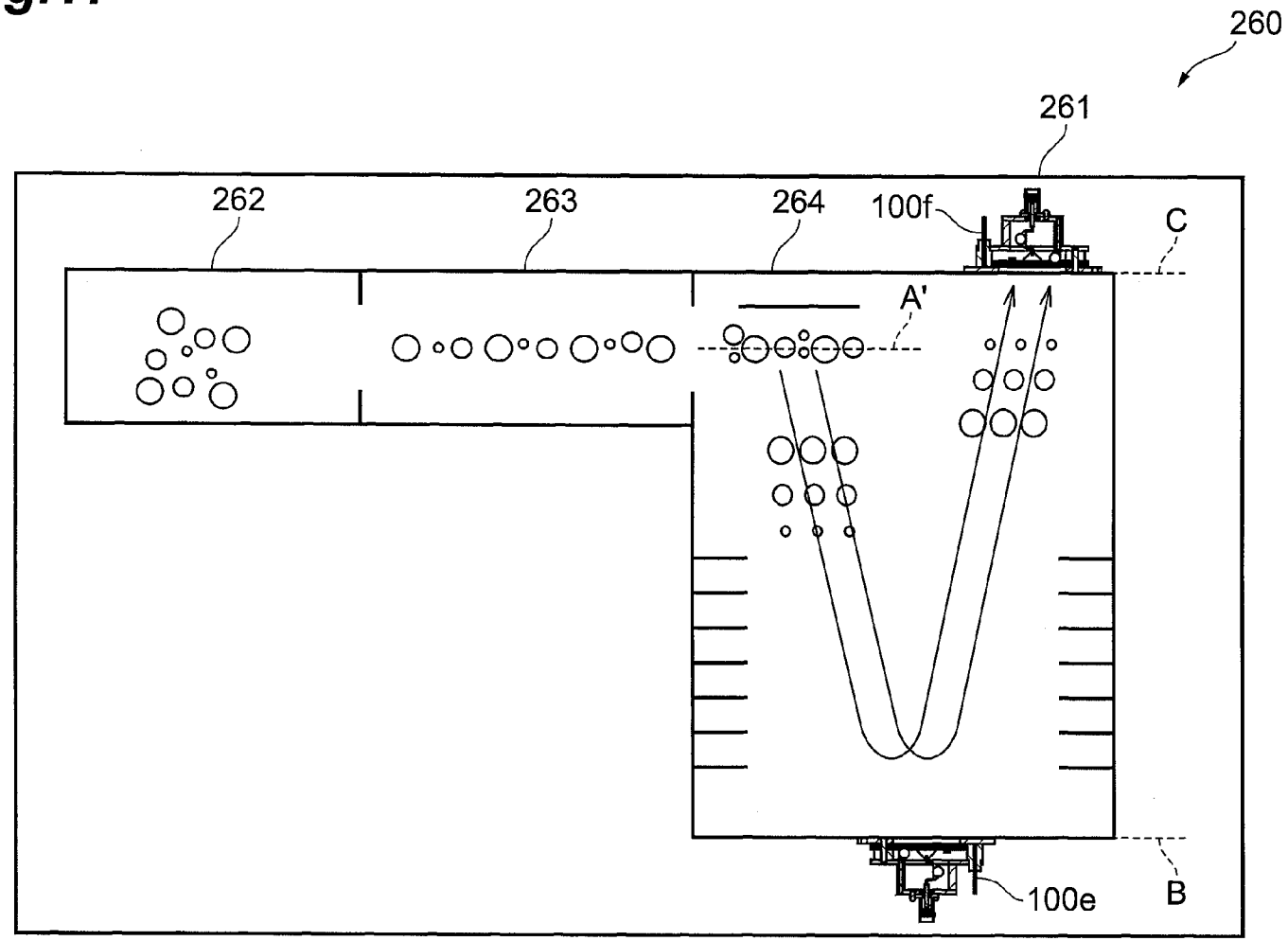

A cabinet 261 that forms a vacuum vessel of the TOF-MS 260 shown in FIG. 17 is common to that of the embodiment shown in FIG. 13 in the point of being internally divided into three chambers 262, 263, and 264, and differs therefrom in the point that the arranging positions of a linear detector 100*e* and a reflectron detector 100*f* are opposing not in a coupling direction of the chambers but in the direction perpendicular thereto. In the case of this construction, retaining each parallelism between a sample plane A' and a mount surface B of the linear detector 100*e* and between the sample plane A' and a mount surface C of a reflectron detector 100*f* makes it easy to maintain the accuracy of the incident surface of each detector 100*e*, 100*f*.

Figure 18:
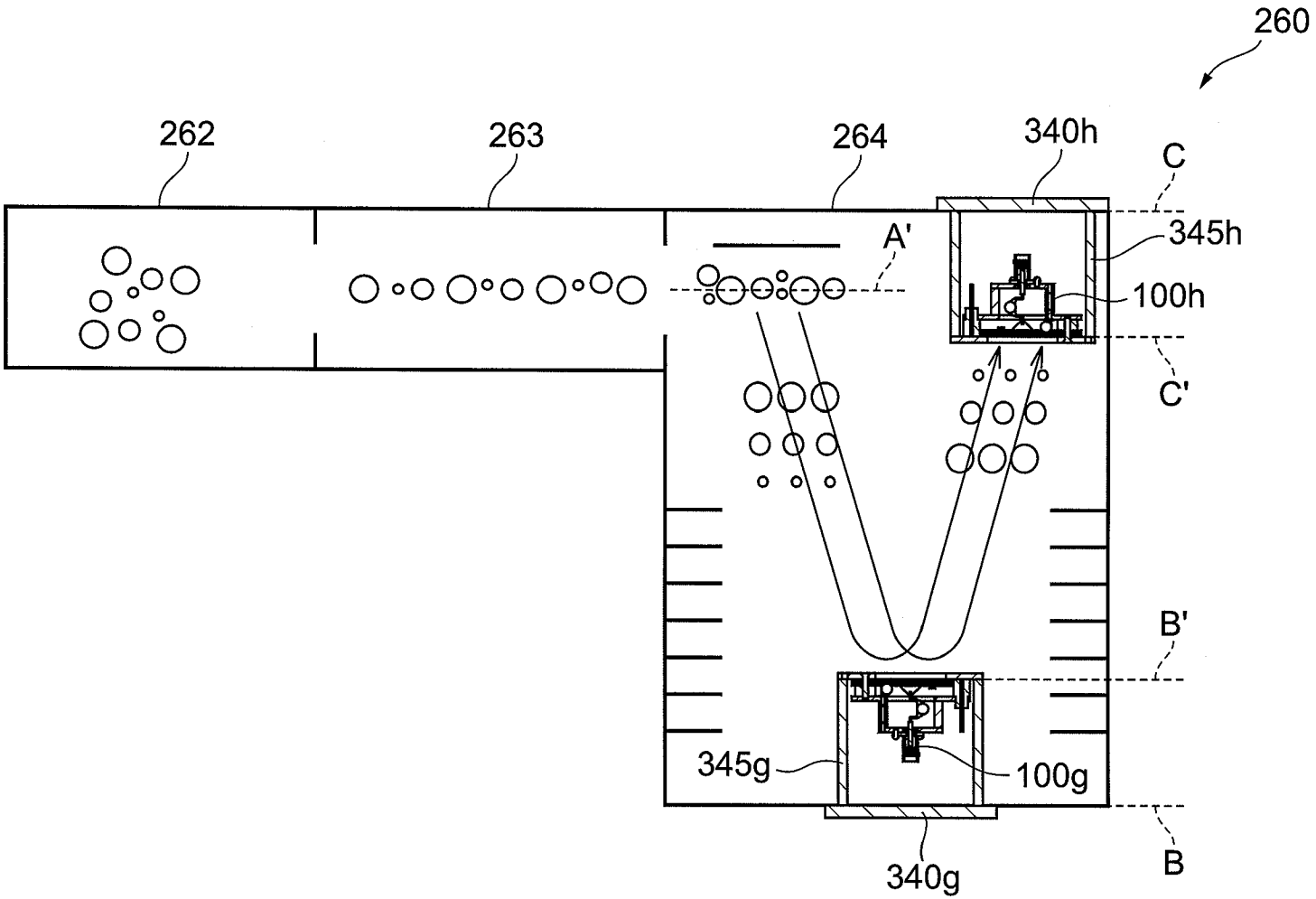
Figure 19:
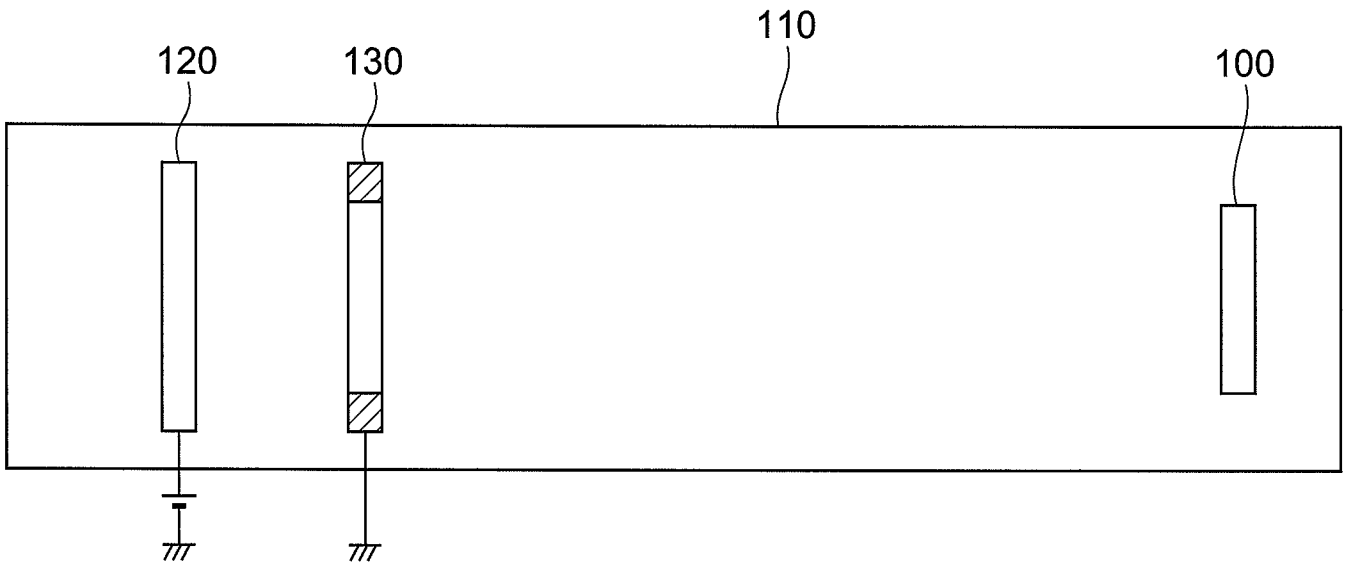
FIG. 19 is a view showing a TOF-MS measurement technique.

The TOF-MS 260 shown in FIG. 18 is the same in the construction of chambers as the embodiment shown in FIG. 17, and common in the mounting method of detectors 100*g* and 100*h* to the embodiment shown in FIG. 16. Also in the case of this construction, retaining each parallelism between a sample plane A' and mount surfaces B and B' of the linear detector 100*g* and between the sample plane A' and mount surfaces C and C' of the reflectron detector 100*h* makes it easy to maintain the accuracy of the incident surface of each detector 100*g*, 100*h*. These three chambers 262, 263, and 264 constitute a vacuum vessel.

The TOF-MS according to the present invention is not limited to the above-mentioned embodiments, and the installation site of the detector 100 can be changed according to necessity. Using a charged particle detecting apparatus having the above-described construction as its detector makes it easy to retain so as to maintain orthogonality of the incident surface of the charged particle detecting apparatus with respect to a desired incidence axis line of charged particles.

In the embodiments described above, two MCPs have been used as the MCP group 2, however, an arbitrary number of MCPs (may be one or three or more) can be used according to the use of the detector. Although the BNC terminal 6 has been used as a signal output part, other output terminals may be used, or it may be a form of output by a coaxial cable. Although a description has been given of the embodiment where metal rods are used as leads 70 to 72, coaxial cable and other lead wires may be used.

In the foregoing, a description has been given of the embodiment of fixation of a charged particle detecting apparatus to a cabinet by providing a female screw on the cabinet and fixing the same by a male screw penetrated through a through-hole provided on the charged particle detecting apparatus, however, fixation is not limited thereto, and a female screw may be provided on the charged particle detecting apparatus, or through-holes may be provided on both the charged particle detecting apparatus and cabinet to be fixed by use of a bolt and a nut, and it may be a socket-type construction where claws are provided on both to be fitted together.

What is claimed is:

1. A charged particle detecting apparatus arranged in a cabinet of a time-of-flight mass spectrometry system including an ion flying region and detecting ions that have flied through the ion flying region used therefore, the charged particle detecting apparatus including:

a microchannel plate, a first electrode arranged on a charged particle incident surface of the microchannel plate, and having an opening to expose the charged particle incident surface of the microchannel plate, a second electrode arranged on an electron exit surface of the microchannel plate with the microchannel plate sandwiched therebetween, and having an opening to expose the electron exit surface of the microchannel plate, a third electrode arranged opposing the exit surface of the microchannel plate with the second electrode sandwiched therebetween, and a rear cover arranged on a surface of the third electrode opposite to a surface opposing the microchannel plate, wherein the first electrode comprises a flange portion to be fitted to the cabinet, and the flange portion is provided in a manner projecting further outside than the components arranged between the rear cover and the first electrode including the rear cover when viewed from the charged particle exit surface side of the microchannel plate, wherein the first electrode is an IN electrode of the microchannel plate, the second electrode is an OUT electrode of the microchannel plate, the third electrode is an anode electrode of the microchannel plate, and wherein the flange portion and the first electrode are an integral one piece structure.

2. A time-of-flight mass spectrometry system having a changed-particle detecting apparatus arranged in a cabinet including an ion flying region and detecting ions that have flied through the ion flying region, wherein the charged particle detecting apparatus includes a microchannel plate, a first electrode arranged on a charged particle incident surface of the microchannel plate, and having an opening to expose the charged particle incident surface of the microchannel plate, a second electrode arranged on an electron exit surface of the microchannel plate with the microchannel plate sandwiched therebetween, and having an opening to expose the electron exit surface of the microchannel plate, a third electrode arranged opposing the exit surface of the microchannel plate with the second electrode sandwiched therebetween, and a rear cover arranged on a surface of the third electrode opposite to a surface opposing the microchannel plate, and the first electrode comprises a flange portion to be fitted to the cabinet, and the flange portion is provided in a manner projecting further outside than the components arranged between the rear cover and the first electrode including the rear cover when viewed from the charged particle exit surface side of the microchannel plate, wherein the first electrode is an IN electrode of the microchannel plate, the second electrode is an OUT electrode of the microchannel plate, the third electrode is an anode electrode of the microchannel plate, and wherein the flange portion and the first electrode are an integral one piece structure.

3. The time-of-flight mass spectrometry system according to claim 2, wherein an insulator is arranged between the flange portion and the cabinet.

4. The time-of-flight mass spectrometry system according to claim 2, comprising an electrically insulating screw member for fixing the flange portion to the cabinet.

5. The time-of-flight mass spectrometry system according to any one of claims 2 to 4, wherein the charged particle detecting apparatus is fixed with a surface of the flange portion facing the microchannel plate facing a fixing wall surface provided on the cabinet.

6. The time-of-flight mass spectrometry system according to any one of claims 2 to 4, wherein the charged particle detecting apparatus is fixed with a face opposite to a surface of the flange portion facing the microchannel plate facing a fixing wall surface provided on the cabinet.

* * * * *